US009273522B2

(12) United States Patent
Hummes et al.

(10) Patent No.: US 9,273,522 B2
(45) Date of Patent: Mar. 1, 2016

(54) STEERING HEAD WITH INTEGRATED DRILLING DYNAMICS CONTROL

(75) Inventors: Olof Hummes, Northrhine-Westfalia (DE); Matthias Meister, Niedersachsen (DE); Sven Krueger, Niedersachsen (DE); Bernd Santelmann, Niedersachsen (DE); Michael Koppe, Niedersachsen (DE)

(73) Assignee: Baker Hughes Incorporated, Houston, TX (US)

( * ) Notice: Subject to any disclaimer, the term of this patent is extended or adjusted under 35 U.S.C. 154(b) by 623 days.

(21) Appl. No.: 13/366,807

(22) Filed: Feb. 6, 2012

(65) Prior Publication Data

US 2013/0092441 A1 Apr. 18, 2013

Related U.S. Application Data

(60) Provisional application No. 61/547,433, filed on Oct. 14, 2011.

(51) Int. Cl.

| | |
|---|---|
| ***E21B 17/07*** | (2006.01) |
| ***E21B 44/00*** | (2006.01) |
| *E21B 7/06* | (2006.01) |

(52) U.S. Cl.

CPC ..... *E21B 17/07* (2013.01); *E21B 44/00* (2013.01); *E21B 7/062* (2013.01)

(58) Field of Classification Search

CPC ..... E21B 44/00; E21B 7/062; E21B 17/07

USPC ..... 175/26, 40, 45, 61, 62, 76

See application file for complete search history.

(56) References Cited

U.S. PATENT DOCUMENTS

| | | | | |
|---|---|---|---|---|
| 4,671,366 | A | 6/1987 | Uitto et al. | |
| 5,540,527 | A | 7/1996 | Bohnet et al. | |
| 5,721,376 | A | 2/1998 | Pavone et al. | |
| 7,219,752 | B2 | 5/2007 | Wassell et al. | |
| 7,377,339 | B2 | 5/2008 | Wassell et al. | |
| 7,406,363 | B2 * | 7/2008 | Doering et al. | 700/284 |
| 7,578,360 | B2 | 8/2009 | Haughom | |
| 7,958,947 | B2 | 6/2011 | Larsson et al. | |
| 2005/0194183 | A1 * | 9/2005 | Gleitman et al. | 175/45 |
| 2007/0227775 | A1 * | 10/2007 | Ma et al. | 175/26 |
| 2009/0229882 | A1 | 9/2009 | Quernheim et al. | |
| 2010/0108306 | A1 | 5/2010 | Cooper | |
| 2010/0139977 | A1 | 6/2010 | Watkins et al. | |

OTHER PUBLICATIONS

International Search Report and Written Opinion dated Feb. 18, 2013 for International Application No. PCT/US2012/058954.

* cited by examiner

*Primary Examiner* — Nicole Coy
*Assistant Examiner* — Kristyn Hall
(74) *Attorney, Agent, or Firm* — Cantor Colburn LLP

(57) ABSTRACT

A method, apparatus and computer-readable medium for reducing a vibration of a drill string in a borehole. A sensor of the drill string obtains one or more measurements of a parameter of the vibration. A processor determines at least one force for controlling the measured vibration from the measured parameter. At least one actuator applies the determined at least one force against the borehole wall to control the vibration of the drill string.

18 Claims, 4 Drawing Sheets

STEERING HEAD WITH INTEGRATED DRILLING DYNAMICS CONTROL

CROSS REFERENCE TO RELATED APPLICATIONS

This application claim priority to U.S. Provisional Application Ser. No. 61/547,433, filed Oct. 14, 2011.

BACKGROUND

Drilling operations generally include a drill string conveyed in a borehole to a formation. A drill bit at a bottom end of a drill string is operated to disintegrate the formation. Drilling the formation generally causes vibrations on the drill string which can cause wear to the drill string, reduce lifetime of the drill string, impair drilling efficiency and lead to rougher cutting of the formation. The present disclosure therefore provides a method and apparatus for controlling vibrations on the drill string.

BRIEF DESCRIPTION

In one aspect, the present disclosure provides a method of reducing a vibration of a drill string in a borehole, including: obtaining one or more measurements of a parameter of the vibration of the drill string; and applying at least one force against a wall of the borehole responsive to the obtained one or more measurements to reduce the vibration of the drill string.

In another aspect, the present disclosure provides an apparatus for controlling a vibration of a drill string in a borehole, the apparatus including: a sensor configured to obtain one or more measurements of a parameter of the vibration; a processor configured to determine at least one force for controlling the measured vibration from the measured parameter; and at least one actuator configured to apply the determined at least one force against the borehole wall to control the vibration of the drill string.

In yet another aspect, the present disclosure provides an apparatus for drilling a borehole, including a drill string; a sensor configured to measure a parameter of a vibration of the drill string; a first actuator configured to apply a first force component to actuate a steering pad of the drill string; a second actuator configured to apply a second force component to actuate the steering pad; and a processor configured to: determine one or more forces for reducing the vibration of the drill string, and operate the first actuator and the second actuator cooperatively to apply the one or more forces to the steering pad.

In yet another aspect, the present disclosure provides a computer-readable medium having a set of instructions stored therein and accessible to a processor to perform a method of controlling a vibration of a drill string, the method comprising: receiving an obtained measurement related to a vibration of the drill string; determining at least one force to control the detected vibration of the drill string from the obtained measurement; and operating at least one actuator of the drill string to apply the at least one force against a wall of the borehole.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
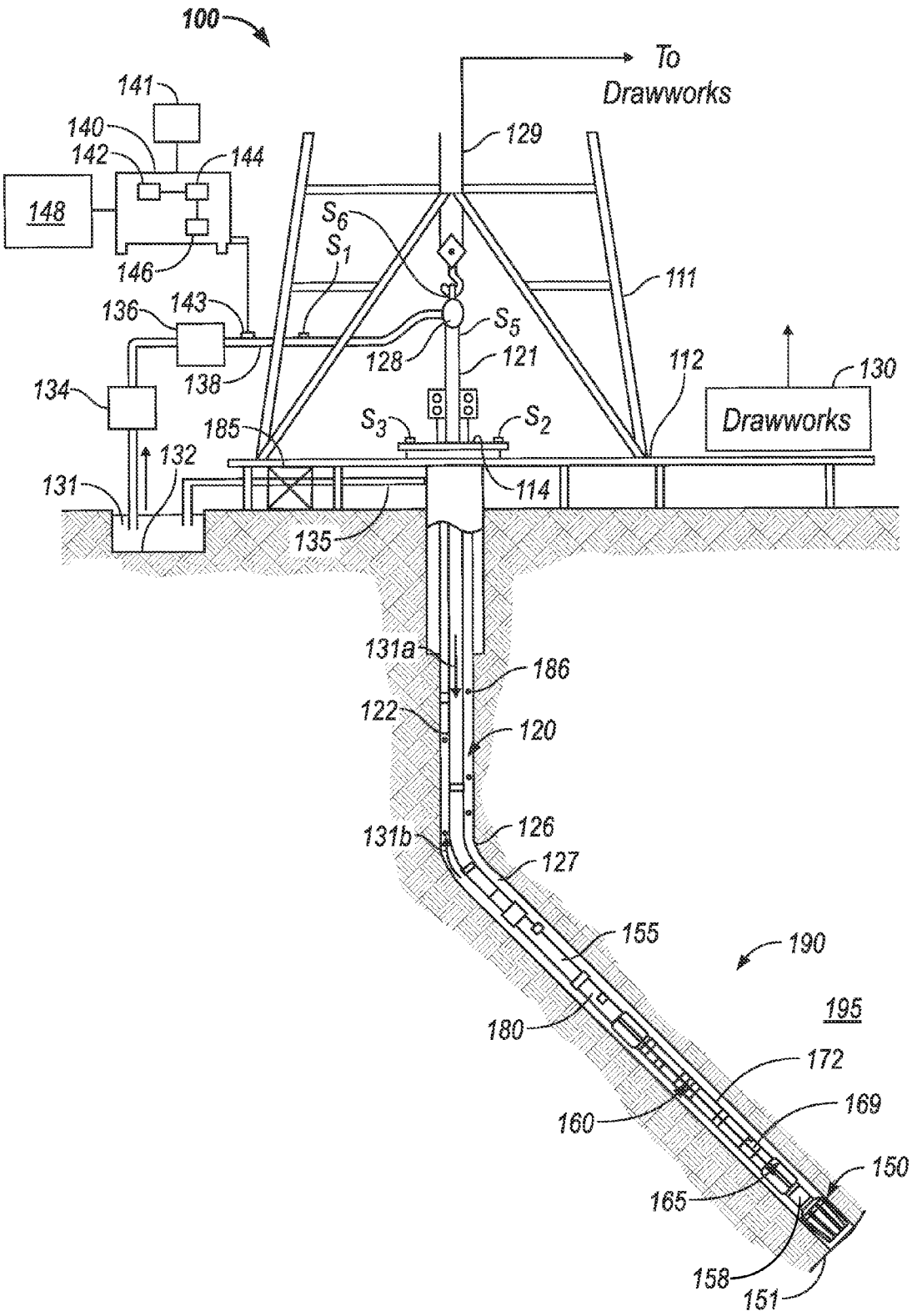
FIG. 1 is a schematic diagram of an exemplary drilling system that includes a drill string having a drilling assembly attached to its bottom end that can be operated according to the exemplary methods disclosed herein.

FIG. 1 is a schematic diagram of an exemplary drilling system 100 that includes a drill string having a drilling assembly attached to its bottom end that can be operated according to the exemplary methods apparatus disclosed herein. FIG. 1 shows a drill string 120 that includes a drilling assembly or bottomhole assembly ("BHA") 190 conveyed in a wellbore 126. The drilling system 100 includes a conventional derrick 111 erected on a platform or floor 112 which supports a rotary table 114 that is rotated by a prime mover, such as an electric motor (not shown), at a desired rotational speed. A tubing (such as jointed drill pipe) 122 having the drilling assembly 190 attached at its bottom end extends from the surface to the bottom 151 of the wellbore 126. A drill bit 150, attached to drilling assembly 190, disintegrates the geological formations when it is rotated to drill the wellbore 126. The drill string 120 is coupled to a drawworks 130 via a Kelly joint 121, swivel 128 and line 129 through a pulley. Drawworks 130 is operated to control the weight on bit ("WOB"). The drill string 120 can be rotated by a top drive (not shown) instead of by the prime mover and the rotary table 114. The operation of the drawworks 130 is known in the art and is thus not described in detail herein.

In an aspect, a suitable drilling fluid 131 (also referred to as "mud") from a source 132 thereof, such as a mud pit, is circulated under pressure through the drill string 120 by a mud pump 134. The drilling fluid 131 passes from the mud pump 134 into the drill string 120 via a de-surger 136 and the fluid line 138. The drilling fluid 131 a from the drilling tubular discharges at the wellbore bottom 151 through openings in the drill bit 150. The returning drilling fluid 131*b* circulates uphole through the annular space 127 between the drill string 120 and the wellbore 126 and returns to the mud pit 132 via a return line 135 and drill cutting screen 185 that removes the drill cuttings 186 from the returning drilling fluid 131*b*. A sensor $S_1$ in line 138 provides information about the fluid flow rate. A surface torque sensor $S_2$ and a sensor $S_3$ associated with the drill string 120 provide information about the torque and the rotational speed of the drill string 120. Rate of penetration of the drill string 120 can be determined from the sensor $S_5$, while the sensor $S_6$ can provide the hook load of the drill string 120.

In some applications, the drill bit 150 is rotated by rotating the drill pipe 122. However, in other applications, a downhole motor 155 (mud motor) disposed in the drilling assembly 190 also rotates the drill bit 150. The rate of penetration ("ROP") for a given drill bit and BHA largely depends on the WOB or the thrust force on the drill bit 150 and its rotational speed.

A surface control unit or controller 140 receives signals from downhole sensors and devices via a sensor 143 placed in the fluid line 138 and signals from sensors $S_1$-$S_6$ and other sensors used in the system 100 and processes such signals according to programmed instructions provided from a program to the surface control unit 140. The surface control unit 140 displays desired drilling parameters and other information on a display/monitor 141 that is utilized by an operator to control the drilling operations. The surface control unit 140 can be a computer-based unit that can include a processor 142 (such as a microprocessor), a storage device 144, such as a solid-state memory, tape or hard disc, and one or more computer programs 146 in the storage device 144 that are accessible to the processor 142 for executing instructions contained in such programs to perform the methods disclosed herein. The surface control unit 140 can further communicate with a remote control unit 148. The surface control unit 140 can process data relating to the drilling operations, data from the sensors and devices on the surface, and data received from downhole and can control one or more operations of the downhole and surface devices. Alternately, the methods disclosed herein can be performed at a downhole processor 172.

The drilling assembly 190 also contains a section 165 having steering pads formed therein. The steering pads can be articulated from the bottomhole assembly 190 to provide a force for stabilizing of the bottomhole assembly within the borehole and/or steering of the drill string during drilling. As discussed below, in an exemplary embodiment, the steering pads can be operated to dampen, control, reduce and/or enhance a vibration in the drill string. The drilling assembly 190 can further include a variety of sensors 158 for determining one or more functions and properties of the drilling assembly (such as velocity, vibration, bending moment, acceleration, oscillations, whirl, stick-slip, etc.) and drilling operating parameters, such as weight-on-bit, fluid flow rate, pressure, temperature, rate of penetration, azimuth, tool face, drill bit rotation, etc. In addition, the drilling assembly 190 can also include one or more accelerometers 169 or equivalent devices for determining an orientation of the drill string in the wellbore. The drilling assembly may further include communication devices for sending signals to and/or receiving signals from a surface location. The signals may include in one aspect, information obtained from sensors 158 and or signals for controlling various operations downhole. A suitable telemetry sub 180 using, for example, two-way telemetry, is also provided as illustrated in the drilling assembly 190 and provides information from the various sensors and to the surface control unit 140.

Still referring to FIG. 1, the drill string 120 further includes energy conversion device 160. In an aspect, the energy conversion device 160 is located in the BHA 190 to provide an electrical power or energy, such as current, to sensors 158. Energy conversion device 160 can include a battery or an energy conversion device that can for example convert or harvest energy from pressure waves of drilling mud which are received by and flow through the drill string 120 and BHA 190. Alternately, a power source at the surface can be used to power the various equipment downhole.

Figure 2:
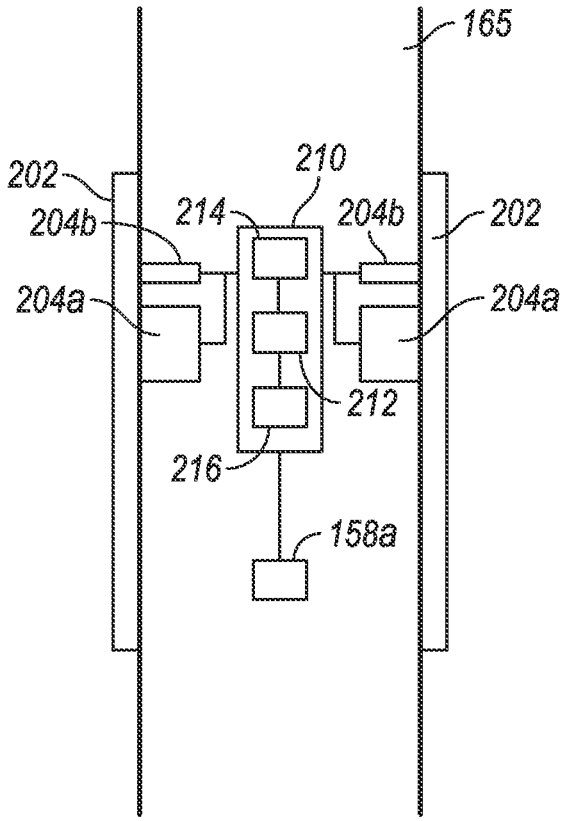
FIG. 2 shows an exemplary section of the bottomhole assembly of FIG. 1 for controlling drill string vibrations in an exemplary embodiment of the present disclosure.

FIG. 2 shows an exemplary section 165 of bottomhole assembly 190 for controlling drill string vibrations in an exemplary embodiment of the present disclosure. The exemplary section 165 includes steering pads 202 disposed at one or more circumferential locations on the BHA 190. The steering pads 202 are operated to apply a substantially radial force on a wall of the wellbore. In one aspect, the steering pads 202 apply a stabilizing force to maintain the drill string at a selected position within the wellbore. In another aspect, the steering pads 202 can be actuated independently to move the longitudinal axis of the drill BHA 190 off of a central position within the wellbore, thereby providing the ability to steer the drill string during drilling The steering pads 202 are coupled to steering pad actuators 204*a* which actuate the steering pads to apply a first force component against a borehole wall to perform stabilization and/or steering aspects of the drill string. The steering pads 202 are also coupled to pulse actuators 204*b* which actuate the steering pads 202 to apply a second force component against the borehole wall to control a vibration of the drill string using various methods discussed herein. In one embodiment, the steering pad actuators 204*a* and the pulse actuators 204*b* can be used cooperatively to apply a force for controlling the vibration of the drill string. The applied force can be a combination or superposition of the first force and the second force. In this embodiment, one actuator (i.e., 204*a*) can be operated at a first (i.e., low) frequency and the other actuator (i.e. 204*b*) can be operated at a second (i.e., high) frequency.

The BHA 190 includes a downhole sensor 158*a* which is typically near the drill bit (not shown) and which is configured to measure a parameter of a vibration in the drill string, such as a force or a pressure. Although only one sensor 158*a* is shown in FIG. 2 for illustrative purposes, it is understood that more than one sensor can be used as well as sensors responsive to different parameters of the vibration. The force or vibration can include vibrations, bending, acceleration, oscillations, and vibrations due to whirl, stick-slip, etc. BHA 190 further includes a downhole controller unit or controller 210 that receives signals from downhole sensor 206 and processes such signals according to programmed instructions provided from a program to the downhole control unit 210. The downhole control unit 210 can be a computer-based unit that can include a processor 212 (such as a microprocessor), a storage device 214, such as a solid-state memory, tape or hard disc, and one or more computer programs 216 in the storage device 214 that are accessible to the processor 212 for executing instructions contained in such programs to perform the methods disclosed herein. The downhole control unit 210 communicates with actuators 204*a* and 204*b* to operate steering pads 202. In one aspect, the downhole control unit 210 receives one or more parameter measurements related to force and/or vibration of the drill string from sensor 158*a* and applies a signal to the actuation devices 204*a* and/or 204*b* to activate the steering pad 202. Processor 212 receives the one or more obtained measurement and determines a force that can be applied to a borehole wall in order to counteract or dampen the vibration. The downhole control unit 210 can further communicate signals to and receive signals from a surface location.

In another embodiment, the processor 212 determines a vibration mode of the drill string. The vibration mode can be determined using one or more measurements received from the sensor 158*a*. For example, the processor 212 can determine from the one or more measurements that the drill string is vibrating in a lateral vibration mode. The processor 212 can then determine a sequence of forces that can be applied at the steering pad to counteract the vibrations of the lateral vibration mode. The processor can further determine various characteristics of the applied force, such as frequency, duration and a magnitude. The processor can also determine a lag time associated with, for example, actuators, steering pads, and various other devices used in applying the sequence of forces. The lag time can be associated with rotation of the drill string and can be selected so as to apply a force at a selected circumferential location of the borehole hole during rotation of the drill string. The lag time can also include an inherent or calculated lag time of the devices applying the at least one force. The lag time can also be a lag time computed for a selected vibration mode. The processor can use the determined lag time in order that the forces are applied at appropriate times. In one embodiment, the processor uses a forward model to determine the sequence of forces that will dampen a selected vibration mode. The forward model can use the one or more sensor measurements and lag times.

Figure 3A:
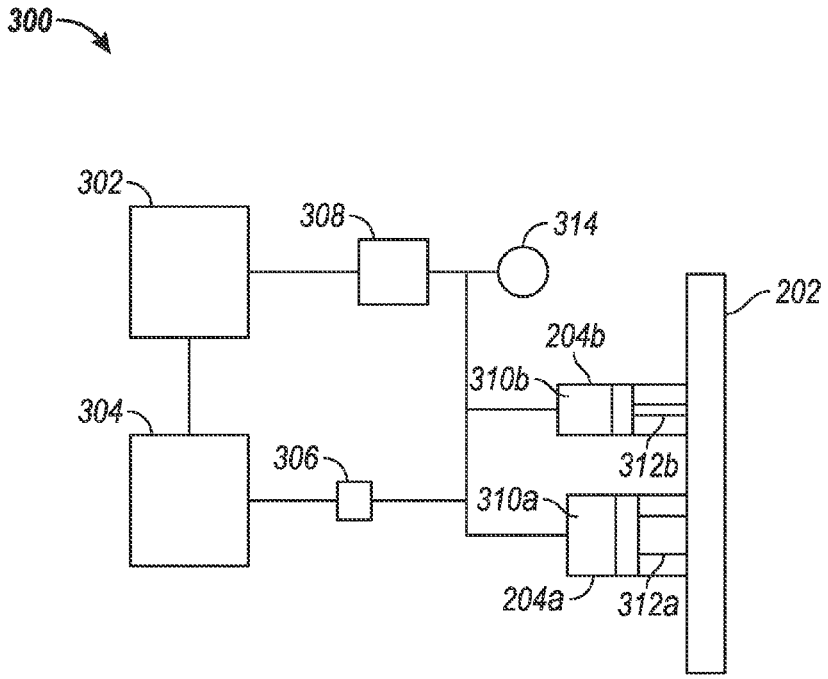
FIG. 3A shows an exemplary system for actuating a steering pad of the exemplary drilling system to apply a force against a wellbore wall in an exemplary embodiment of the present disclosure.

FIG. 3A shows an exemplary system 300 for actuating the steering pad 202 to apply a force against a wellbore wall in an exemplary embodiment of the present disclosure. The exemplary system 300 in one embodiment is a hydraulic system that includes a reservoir 302 of hydraulic fluid and a hydraulic drive circuit 304 for circulating the hydraulic fluid. The exemplary system 300 further includes a nozzle 306, a pressure sensor 314 and pressure control valve 308. Nozzle 306 regulates pressure of the hydraulic fluid in the system. Nozzle 306 can be a flow resistor nozzle in one embodiment. Hydraulic fluid from the nozzle 306 is directed to steering actuator 204*a* and/or pulse actuator 204*b* which are coupled to steering pad 202. Actuators 204*a* and 204*b* move the steering pad 202 in response to changes in the pressure of the hydraulic fluid. Hydraulic fluid returns from the actuators 204*a* and 204*b* via pressure control valve 308. Pressure sensor 314 can be used to measure pressure of the hydraulic fluid.

Actuator 204*a* includes a housing 310*a* that includes a piston 312*a* and various devices for moving the piston in order to apply a force at the steering pad 202. Similarly, actuator 204*b* includes housing 310*b* that includes a piston 312*b* and various devices for moving the piston to apply a force at the steering pad 202 for compensating drill string vibrations. As described herein, actuators 204*a* and 204*b* are hydraulically activated. In various alternative embodiments, the actuators 204*a* and 204*b* can be any form of linear actuator, including a linear drive motor, a spindle actuator, a pump actuator, a piezoelectric device, a solenoid and a magnetorestrictive device, a motor, an electrical drive motor, and a hydraulic pump, among others. Typically, piston 312*b* has less mass than piston 312*a* and is of a smaller radius than piston 312*a*. The piston 312*a* is designed according to parameters that enable application of strong, long-term force of the steering pad against the borehole wall for stabilization and/or steering. The piston 312*b* is designed according to parameters that enable quick motion of the piston for applying a short-term force for vibration control. Thus, the pulse actuator 204*b* and piston 312*b* are typically selected for applying forces at a frequency of vibration of the drill string. Typically this frequency of vibration is in a range from about 0.010 Hertz (Hz) to about 10,000 Hz. In one embodiment, piston 312*b* can be designed with an elongated piston of small diameter in combination with a solenoid driving in a reciprocating manner to provide high pressure at low driving force and large piston stroke. In another embodiment, piston 312*b* can include an increased diameter piston or membrane in combination with a piezoelectric actuator. In an alternate embodiment, spindle-driven piston or other high dynamic drive or activation mechanism can be used to activate and control the steering pads. Such mechanisms typically have high dynamic control suitable for vibration control.

In the exemplary embodiment of the present disclosure, at least one steering pad can be moved or pulsed in the radial direction in order to provide a force directed against the wall of the borehole. The pulse may be of a selected duration, amplitude and/or frequency. Combined with a high frequency force and vibration measurement system, the control software can verify the vibration pattern and actively push the pads out to prevent the drill bit from entering into a severe vibration mode, such as a whirl mode, or to return the drill bit back to smooth rotation, i.e., substantially vibration-free.

Figure 3B:
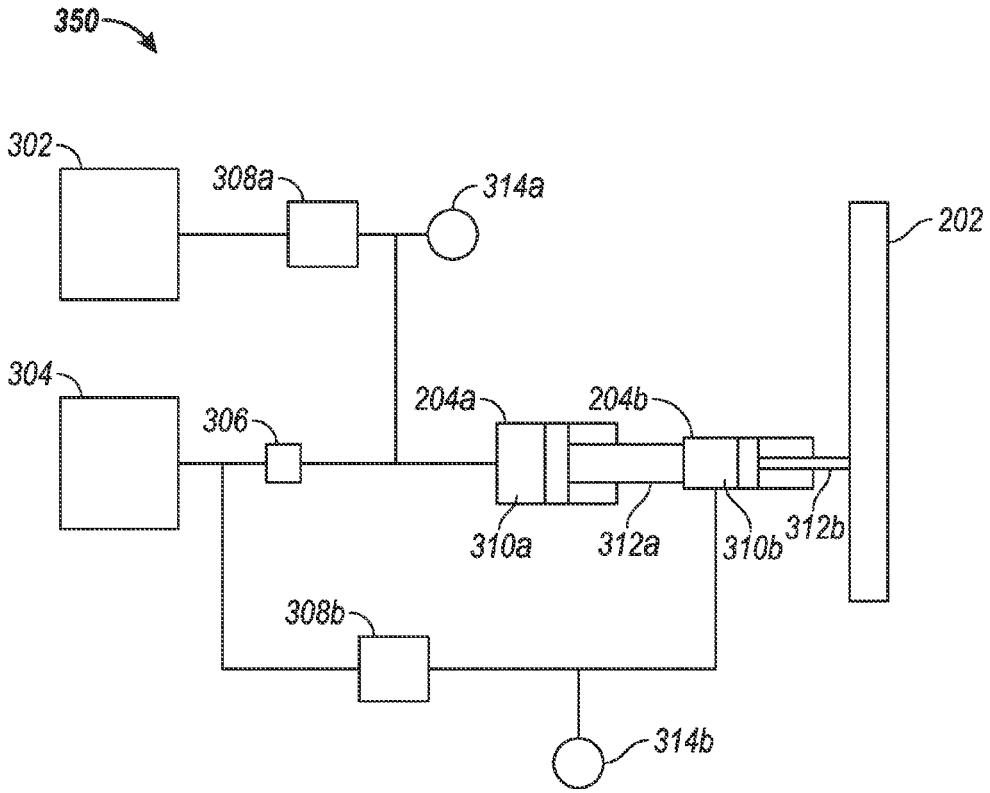
FIG. 3B shows an alterative system for actuating a steering pad of the drilling system to apply a force against wellbore wall.

FIG. 3B shows an exemplary system 350 an alternative embodiment for actuating the steering pad to apply a force against wellbore wall. The exemplary system 350 includes a steering actuator 204*a* and pulse actuator 204*b* serially connected. The steering actuator 204*a* includes housing 310*a* and piston 312*a* which can be activated at a first frequency. The piston 312*a* is coupled to the pulse actuator 204*a* so that actuation of the piston 312*a* moves the pulse actuator 204*a* linearly. The pulse actuator includes housing 310*b* and piston 312*b* which can be activated at a second frequency different from the first frequency. The piston 312*b* is coupled to the steering pad 202 so that actuation of the piston 312*b* moves the steering pad 202 in a radial direction from the drill string. The steering actuator 204*a* and pulse actuator 204*b* can be cooperative actuated to provide a force at the steering pad that is a combination of a first force from the steering actuator 204*b* and a second force from the pulse actuator 204*b*. In various embodiments, these first and second forces are periodically or semi-periodically applied.

The system 350 includes a hydraulic fluid reservoir 302, valve 308*a* and pressure sensor 314*a* providing hydraulic fluid to the steering actuator 240*a*. Hydraulic drive circuit 304 circulates the hydraulic fluid throughout hydraulic line 321. Nozzle 306 regulates pressure of the hydraulic fluid in the hydraulic line 321. Second valve 308*b* and second pressure sensor 314*b* are disposed in a section of the hydraulic line 321 between the hydraulic drive circuit 304 and the pulse actuator 204*b*. The second valve 308*b* and second pressure sensor 314*b* can be used to control actuator 204*b* independent of actuator 204*a*.

Figure 4A:
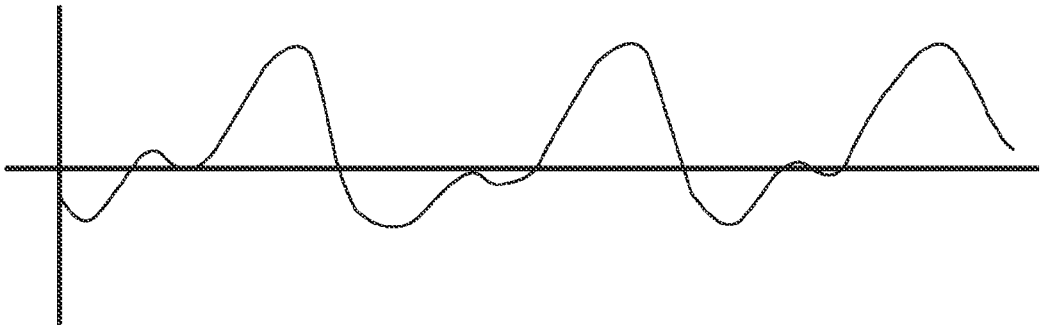
FIG. 4A shows an exemplary vibration mode of a drill string.
Figure 4B:
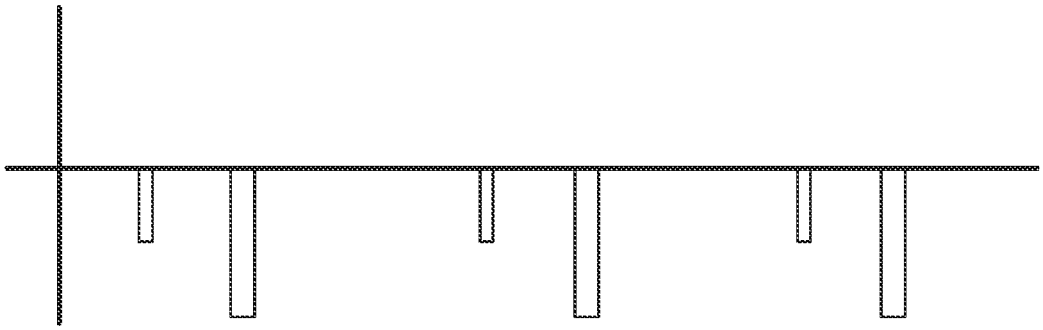
FIG. 4B shows an exemplary force sequence for compensating the vibration mode of FIG. 4A.
Figure 4C:
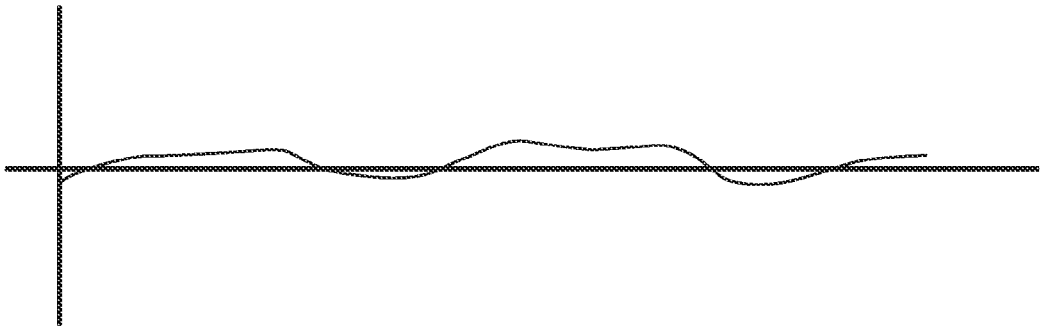
FIG. 4C shows an exemplary vibration amplitude resulting from application of the force sequence of FIG. 4B to the vibration mode of FIG. 4A.

FIG. 4A shows an exemplary vibration mode of a drill string. Time is along the horizontal axis and vibration amplitude is along the vertical axis. The vibration mode displays a repeated sequence. The vibration is measured at the exemplary sensor 158*a* and sent to the processor, which determines a force sequence that is timed to dampen the vibration mode. An exemplary force sequence is shown in FIG. 4B. FIG. 4C shows an exemplary vibration amplitude resulting from application of the force sequence of FIG. 4B to the vibration ode of FIG. 4A. The methods disclosed herein for dampening vibration therefore leads to extended lifetime of a drill assembly and/or drill string, less wear, improved drilling efficiency and smoother cutting.

Therefore, in one aspect, the present disclosure provides a method of reducing a vibration of a drill string in a borehole, including: obtaining one or more measurements of a parameter of the vibration of the drill string; and applying at least one force against a wall of the borehole responsive to the obtained one or more measurements to reduce the vibration of the drill string. In one embodiment, a single force is applied in response to a single obtained measurement. In another embodiment, the method further includes determining a vibration mode of the drill string using one or more measurements; determining a sequence of forces for reducing vibrations of the determined vibration mode; and applying the determined sequence of forces against the wall of the borehole. The method includes applying the at least one force at a lag time computed to compensate for at least one of: (i) a rotation of the drill string with respect to the borehole wall;

(ii) a lag time of a device for applying the at least one force; and (iii) a determined vibration mode. The measured vibrations can be input to a forward model to determine the sequence of forces. In one aspect, applying the at least one force further comprises operating a first actuator to apply a first force component and a second actuator to apply a second force component to a steering pad of the drill string, wherein the at least one force is a combination of the first force component and the second force component. At least one of the first actuator and the second actuator can be one of a linear drive motor, a spindle drive, a pump actuator, a piezoelectric device, a solenoid, a magneto-restrictive device, a motor, an electrical motor drive, and a hydraulic pump. The vibration on the drill string can be a forward bit whirl, a backward bit whirl, a lateral vibration, a vibration of a bottomhole assembly of the drill string, and a vibration in the drill string above the bottomhole assembly, for example. The steering pad is typically actuated at a frequency from about 0.010 Hz to about 10,000 Hz.

In another aspect, the present disclosure provides an apparatus for controlling a vibration of a drill string in a borehole, the apparatus including: a sensor configured to obtain one or more measurements of a parameter of the vibration; a processor configured to determine at least one force for controlling the measured vibration from the measured parameter; and at least one actuator configured to apply the determined at least one force against the borehole wall to control the vibration of the drill string. The processor in one embodiment is configured to determine a single force in response to a single obtained measurement. In another embodiment, the processor is further configured to determine a vibration mode of the drill string; determine a sequence of forces for controlling the determined vibration mode of the drill string; and provide an actuating signal to the actuator to apply the sequence of forces. The processor is further configured compute a lag time for activating the at least one actuator to compensate for at least one of: (i) a rotation of the drill string with respect to the borehole wall; (ii) an inherent lag time of the at least one actuator; and (iii) a determined vibration mode. The processor is also further configured to input the one or more measurements into a forward model to determine the sequence of forces. The at least one actuator can include a first actuator to configured to apply a first force component and a second actuator configured to apply a second force component to a steering pad of the drill string, wherein the at least one force applied against the borehole wall is a combination of the first force component and the second force component. In various embodiments, the at least one actuator can be a linear drive motor, a spindle drive, a pump actuator, a piezoelectric device, a solenoid, a magneto-restrictive device, a motor, an electrical motor drive, and a hydraulic pump, for example. The vibration on the drill string can be a forward bit whirl, a backward bit whirl, a lateral vibration, a vibration of a bottomhole assembly of the drill string, and a vibration in the drill string above the bottomhole assembly. The at least one actuator is configured to move the steering pad at a frequency from about 0.010 Hz to about 10,000 Hz.

In yet another aspect, the present disclosure provides an apparatus for drilling a borehole, including a drill string; a sensor configured to measure a parameter of a vibration of the drill string; a first actuator configured to apply a first force component to actuate a steering pad of the drill string; a second actuator configured to apply a second force component to actuate the steering pad; and a processor configured to: determine one or more forces for reducing the vibration of the drill string, and operate the first actuator and the second actuator cooperatively to apply the one or more forces to the steering pad.

In yet another aspect, the present disclosure provides a computer-readable medium having a set of instructions stored therein and accessible to a processor to perform a method of controlling a vibration of a drill string, the method comprising: receiving an obtained measurement related to a vibration of the drill string; determining at least one force to control the detected vibration of the drill string from the obtained measurement; and operating at least one actuator of the drill string to apply the at least one force against a wall of the borehole.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A method of reducing a vibration of a drill string in a borehole, comprising:

coupling a first actuator and a second actuator to a steering pad of the drill string, wherein the first actuator and the second actuator are driven by a hydraulic fluid flowing in a hydraulic circuit;

obtaining one or more measurements of a parameter of the vibration of the drill string; and driving the hydraulic fluid to activate the first actuator and the second actuator to apply a first force and a second force, respectively, at the steering pad against a wall of the borehole responsive to the obtained one or more measurements, wherein the first actuator applies the first force at a first frequency and the second actuator applies the second force at a second frequency different from the first frequency and a combination of the first force and the second force reduces the vibration of the drill string.

2. The method of claim 1 further comprising applying the first force and the second force in response to a single obtained measurement.

3. The method of claim 1 further comprising:

determining a vibration mode of the drill string using one or more measurements;

determining a sequence of forces for reducing vibrations of the determined vibration mode; and applying the determined sequence of forces against the wall of the borehole.

4. The method of claim 3, further comprising inputting the measured vibrations to a forward model to determine the sequence of forces.

5. The method of claim 1 further comprising applying the first force and the second force at a lag time computed to compensate for at least one of: (i) a rotation of the drill string with respect to the wall of the borehole; (ii) a lag time of a device for applying at least one of the first force and the second force; and (iii) a determined vibration mode.

6. The method of claim 1, wherein at least one of the first actuator and the second actuator is selected from the group consisting of: (i) a linear drive motor; ii) a spindle drive; (iii) a pump actuator; (iv) a piezoelectric device; (v) a solenoid; (vi) a magneto-restrictive device; (vii) a motor; (viii) an electrical motor drive; and (ix) a hydraulic pump.

7. The method of claim 1, wherein the vibration of the drill string is at least one selected from the group consisting of: (i) forward bit whirl; (ii) backward bit whirl; (iii) lateral vibration; (iv) a vibration of a bottomhole assembly of the drill string; and (v) a vibration in the drill string above the bottomhole assembly.

8. The method of claim 1, further comprising actuating the steering pad at a frequency from about 0.010 Hz to about 10,000 Hz.

9. An apparatus for controlling a vibration of a drill string in a borehole, comprising:

a sensor configured to obtain one or more measurements of a parameter of the vibration;

a processor configured to determine at least one force for controlling the measured vibration from the measured parameter;

a closed hydraulic circuit having a hydraulic fluid therein that is driven through the circuit;

a first actuator coupled to a steering pad of the drill string configured to be activated by a pressure of the hydraulic fluid to apply a first force having a first frequency at the steering pad against the borehole wall;

a second actuator coupled to the steering pad of the drill string configured to be activated by the pressure of the hydraulic fluid to apply a second force having a second frequency different from the first frequency at the steering pad against the borehole wall, wherein a combination of the first force and the second force controls the vibration of the drill string.

10. The apparatus of claim 9, wherein the processor is configured to determine the first force and the second force in response to a single obtained measurement.

11. The apparatus of claim 9, wherein the processor is further configured to:

determine a vibration mode of the drill string;

determine a sequence of forces for controlling the determined vibration mode of the drill string; and provide an actuating signal to the first actuator and the second actuator to apply the sequence of forces.

12. The apparatus of claim 11, wherein the processor is further configured to compute a lag time for activating the first actuator and second actuator to compensate for at least one of: (i) a rotation of the drill string with respect to the wall of the borehole; (ii) an inherent lag time of at least one of the first actuator and the second actuator; and (iii) a determined vibration mode.

13. The apparatus of claim 11, wherein the processor is configured to input the one or more measurements into a forward model to determine the sequence of forces.

14. The apparatus of claim 13, wherein at least one of the first actuator and the second actuator is selected from the group consisting of: (i) a linear drive motor; (ii) a spindle drive; (iii) a pump actuator; (iv) a piezoelectric device; (v) a solenoid; and (vi) a magneto-restrictive device; (vii) a motor; (viii) an electrical motor drive; and (ix) a hydraulic pump.

15. The apparatus of claim 13, wherein the vibration of the drill string is at least one selected from the group consisting of: (i) forward bit whirl; (ii) backward bit whirl; (iii) lateral vibration; (iv) a vibration of a bottomhole assembly of the drill string; and (v) a vibration in the drill string above the bottomhole assembly.

16. The apparatus of claim 13, wherein the combination of the first force and the second force moves the steering pad at a frequency from about 0.010 Hz to about 10,000 Hz.

17. An apparatus for drilling a borehole, comprising:

a drill string;

a sensor configured to measure a parameter of a vibration of the drill string;

a closed hydraulic circuit having a hydraulic fluid therein that is driven through the circuit;

a first actuator configured to be activated by a pressure of the hydraulic fluid in the circuit to apply a first force having a first frequency to actuate a steering pad of the drill string;

a second actuator configured to be activated by the pressure of the hydraulic fluid in the circuit to apply a second force having a second frequency different from the first frequency to actuate the steering pad; and a processor configured to:

determine one or more forces for reducing the vibration of the drill string, and apply a pressure to the hydraulic fluid to operate the first actuator and the second actuator cooperatively to apply a combination of the first force and the second force to the steering pad.

18. A non-transitory computer-readable medium having a set of instructions stored therein and accessible to a processor to perform a method of controlling a vibration of a drill string, the set of instructions comprising:

an instruction to receive an obtained measurement related to the vibration of the drill string;

an instruction to determine a first force at a first frequency and a second force at a second frequency different from the first frequency, wherein a combination of the first force and the second force controls the detected vibration of the drill string from the obtained measurement; and an instruction to apply a pressure to a hydraulic fluid in a closed hydraulic circuit in fluid communication with a first actuator and a second actuator coupled to a steering pad of the drill string in order to apply the first force and the second force, respectively, at the steering pad against a wall of the borehole to control the vibration of the drill string.

* * * * *